United States Patent [19]

Habiger et al.

[11] 4,093,092

[45] June 6, 1978

[54] LOAD LIMITING DEVICE

[75] Inventors: Cyril W. Habiger, Joliet; Tom E. Robinson, Peoria, both of Ill.

[73] Assignee: Caterpillar Tractor Co., Peoria, Ill.

[21] Appl. No.: 669,936

[22] Filed: Mar. 24, 1976

[51] Int. Cl.[2] ..... B66F 9/20

[52] U.S. Cl. ..... 214/674; 91/31; 91/412; 91/451

[58] Field of Search ..... 91/412, 447, 29, 31, 91/33, 414, 452, 468, 451; 214/673, 674

[56] References Cited

U.S. PATENT DOCUMENTS

| | | | |
|---|---|---|---|
| 3,307,656 | 3/1967 | Susag | 187/9 |
| 3,478,646 | 11/1969 | Cryder | 91/412 |
| 3,831,492 | 8/1974 | Young | 91/412 |
| 3,866,419 | 2/1975 | Paul | 60/484 |
| 3,868,821 | 3/1975 | Ratliff | 91/412 |
| 3,922,954 | 12/1975 | Gustafsson | 91/412 |
| 3,929,244 | 12/1975 | Ekstrom | 91/412 |
| 3,960,286 | 6/1976 | Spooner | 91/412 |

*Primary Examiner*—Martin P. Schwadron
*Assistant Examiner*—Abraham Hershkovitz
*Attorney, Agent, or Firm*—Phillips, Moore, Weissenberger, Lempio & Majestic

[57] ABSTRACT

The invention is concerned with an improvement in a load lifting apparatus which comprises a primary load member pivotally mounted about a generally horizontal axis on a frame, a tilt cylinder and a tilt piston movable relative to one another pivotally connected to the frame and the primary load member to provide impetus for pivotal movement therebetween, a secondary load member movable relative to the primary load member, a lift cylinder and a lift piston movable relative to one another connected to the primary load member and the secondary load member to provide impetus for linear relative movement therebetween, tilt cylinder valve means for controlling flow of pressurized fluid from pump means to the tilt cylinder and lift cylinder valve means for controlling flow of pressurized fluid from the pump means to the lift cylinder. The improvement of the invention provides protection which prevents the apparatus from overbalancing. The improvement operates by sensing a moment created by a load on the apparatus. Most particularly, the improvement comprises a valve sensing simultaneously a lift pressure force proportional to a lift pressure in a head end of the lift cylinder and a tilt pressure force proportional to a tilt pressure in a rod end of the tilt cylinder. The valve blocks flow of pressurized fluid from the tilt cylinder to the tilt cylinder valve means and from the lift cylinder valve means to the lift cylinder responsive to the greater of the lift pressure force and the tilt pressure force exceeding a predetermined value. The improvement of the present invention is particularly useful in the lift trucks wherein the primary load member is a lift truck mast and the secondary load member is the forks of a lift truck.

12 Claims, 3 Drawing Figures

LOAD LIMITING DEVICE

BACKGROUND OF THE INVENTION

1. Field of the Invention

The invention is concerned with the counterbalancing of vehicles that are capable of lifting, tilting or shifting a load relative to the vehicle frame and, more particularly, to an overload protecting or load limiting device for use on such a vehicle to prevent overturning of the vehicle during movement of the load.

2. Prior Art

While the present disclosure is directed primarily to load limiting devices for lift trucks it is to be understood that lift trucks are only representative of a general class of counterbalance vehicles which also include front end loaders, back hoes, tree diggers, cranes, two trucks and the like.

A lift truck is used to move heavy loads from one place to another. It includes a vertically extending primary load member commonly referred to as a mast which is pivotally connected to a frame of the truck. Generally, the truck rides upon wheels in a normal manner. A hydraulic piston-cylinder device is generally used to tilt the mast relative to the frame about a pivot point. A secondary load member, for example a pair of forks, are movable along the mast and in certain applications are capable of tranversing the mast. The truck can thus pick up, transport, elevate, lower, shift and/or tilt a load for placement purposes.

It has been a major problem of the prior art in operating such a vehicle that the vehicle tends to tilt about one of the wheel axles thus causing the vehicle to overturn. An overturn condition comes into existence, of course, when the center of gravity of the lift truck, including the load, falls either forwardly of the front axle of the truck or rearwardly of the rear axle of the truck. This condition can be caused by any one of a number of factors. For example, the size of the load, the distance of the center of gravity of the mast, forks and load from the respective front or rear axle, dynamic forces created by acceleration and deceleration of the truck, dynamic forces created during elevation, lowering and tilting of the mast and forks and the like. It is also possible for lift trucks to be overturned sideways about the front and rear wheels on either side of the lift truck. In sidewise overturning the dynamic forces of shifting a load sideways must be considered as well as the distance of the composite center of gravity of the mast, sideways extending forks and load from the wheels of the truck.

A great number of attempts have been made to solve the overturning problem in lift trucks. A discussion of many of these attempts may be found in U.S. Pat. No. 3,831,492 to Young. The Young patent itself teaches an overload protection device which includes a fluid activated double-acting piston-cylinder and a pressure-actuated valve which operates in response to a pressure signal respresentative of the difference in pressure on opposite sides of the piston to prevent movement of the load members in one direction when the overturning moment on the vehicle exceeds a safe value. The device of the Young patent is useful in accomplishing overload protection, but is relatively complicated in structure. U.S. Pat. No. 3,866,419 to Paul discloses an integrated pressure-compensated load sensing system for a lift truck or the like which, again, is rather complicated in structure U.S. Pat. No. 3,307,656 to Susag discloses a relief valve means for preventing overturning of a lift truck.

The prior art devices for preventing overturning of a lift truck or the like suffer from any one or more of the following disadvantages: they fail to permit certain needed operations of the lift truck when a non-dangerous overload condition exists, e.g. increasing tilt or lowering of the load; they are too expensive; they are difficult to install; they reduce the efficiency of the vehicle; they operate in a manner which can cause overturning of the vehicle; they do not detect the overturning moment created by the load; they cannot be easily fitted on to existing vehicles; they create false overload signals causing intermittent operation of the vehicle when an overload condition does not exist; they lack flexibility for readily adapting them to a wide range of vehicles; and they are so complicated that they provide serious maintenance and adjustment problems.

It is accordingly a primary object of the invention to provide a relatively compact load-limiting device for use in a load limiting apparatus, which device has none of the abovementioned drawbacks.

SUMMARY OF THE INVENTION

The invention is concerned with an improvement in a load-lifting apparatus which comprises a primary load member pivotally mounted about a generally horizontal axis on a frame, a tilt cylinder and a tilt piston movable relative to one another pivotally connected to the frame and the primary load member to provide impetus for pivotal movement therebetween, a secondary load member movable relative to the primary load member, a lift cylinder and a lift piston movable relative to one another connected to the primary load member and the secondary load member to provide impetus for linear relative movement therebetween, tilt cylinder valve means for controlling flow of pressurized fluid from pump means to the tilt cylinder and lift cylinder valve means for controlling flow of pressurized fluid from the pump means to the lift cylinder. The improvement of the present invention serves to protect the apparatus from overbalancing by sensing a moment created by a load on the apparatus. The improvement comprises a valve sensing simultaneously a lift pressure force proportional to a lift pressure in a head end of the lift cylinder and a tilt pressure force proportional to a tilt pressure in a rod end of the tilt cylinder, the valve blocking flow of pressurized fluid from the tilt cylinder to the tilt cylinder valve means and from the lift cylinder valve means to the lift cylinder responsive to the greter of the lift pressure force and the tilt pressure force exceeding a predetermined value.

BRIEF DESCRIPTION OF THE DRAWINGS

The invention will be better understood by reference to the figures of the drawings wherein like members denote like parts throughout and wherein.

DETAILED DESCRIPTION OF THE PREFERRED EMBODIMENT

Figure 1:
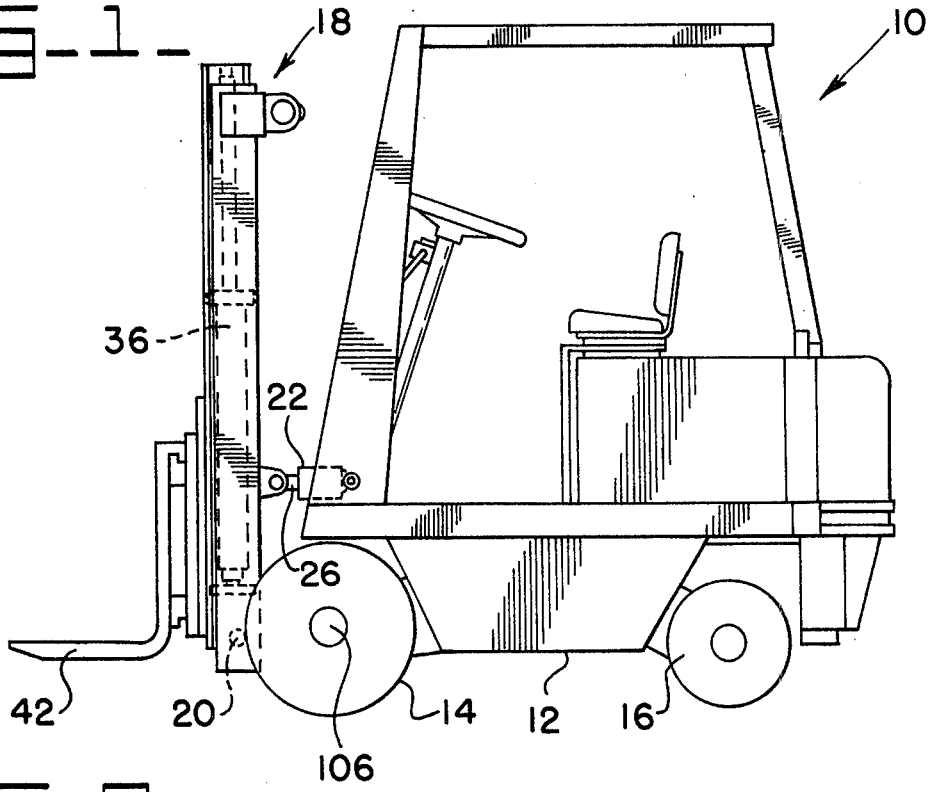
FIG. 1 illustrates in side elevation a lift truck including a mast and fork assembly.

Turning first to FIG. 1, there is illustrated therein a load lifting apparatus or more particularly a lift truck 10. The lift truck 10 includes a frame 12 movable upon a set of front wheels 14 and a set of rear wheels 16 in a conventional manner motivated by an engine held within the frame 12. The lift truck 10 includes a primary load member, namely a mast 18 pivotally mounted about a generally horizontal axis at a pivot 20 to the frame 12. A tilt cylinder 22 is mounted to the frame 12 and a tilt piston 24 is mounted via a tilt rod 26 to the mast 18. The tilt cylinder 22, along with the tilt piston 24 and the tilt rod 26 extending from a rod end 28 of the tilt cylinder 22, together form a hydraulic tilt motor 29 for tilting the mast 18 about the generally horizontal pivot 20 relative to the frame 12. A head end 30 of the tilt cylinder 22 is in flow communication with tilt cylinder valve means, in the embodiment illustrated a tilt valve 32 as represented by a line 34.

A lift cylinder 36 and a lift piston 38 operating via a lift rod 40 with the lift piston 38 and a lift rod 40 being movable relative to the lift cylinder 36 in the usual manner serve to provide impetus for linear relative movement between a secondary load member, generally a pair of forks 42 one of which is illustrated in FIG. 1 and the mast 18. Thus, the lift cylinder 36, the lift piston 38 and the lift rod 40 together comprise a hydraulic lift motor 44. A lift valve 45 controls fluid flow from the pump 35 to and from the hydraulic lift motor 44. A relief valve 46 communicates the output of the pump 35 via a pressure relief line 48 with a sump 50 when pressure in a line 52 from the pump 35 to the tilt valve 32 and the lift valve 45 exceeds a value determined by said relief valve 46.

Figure 2:
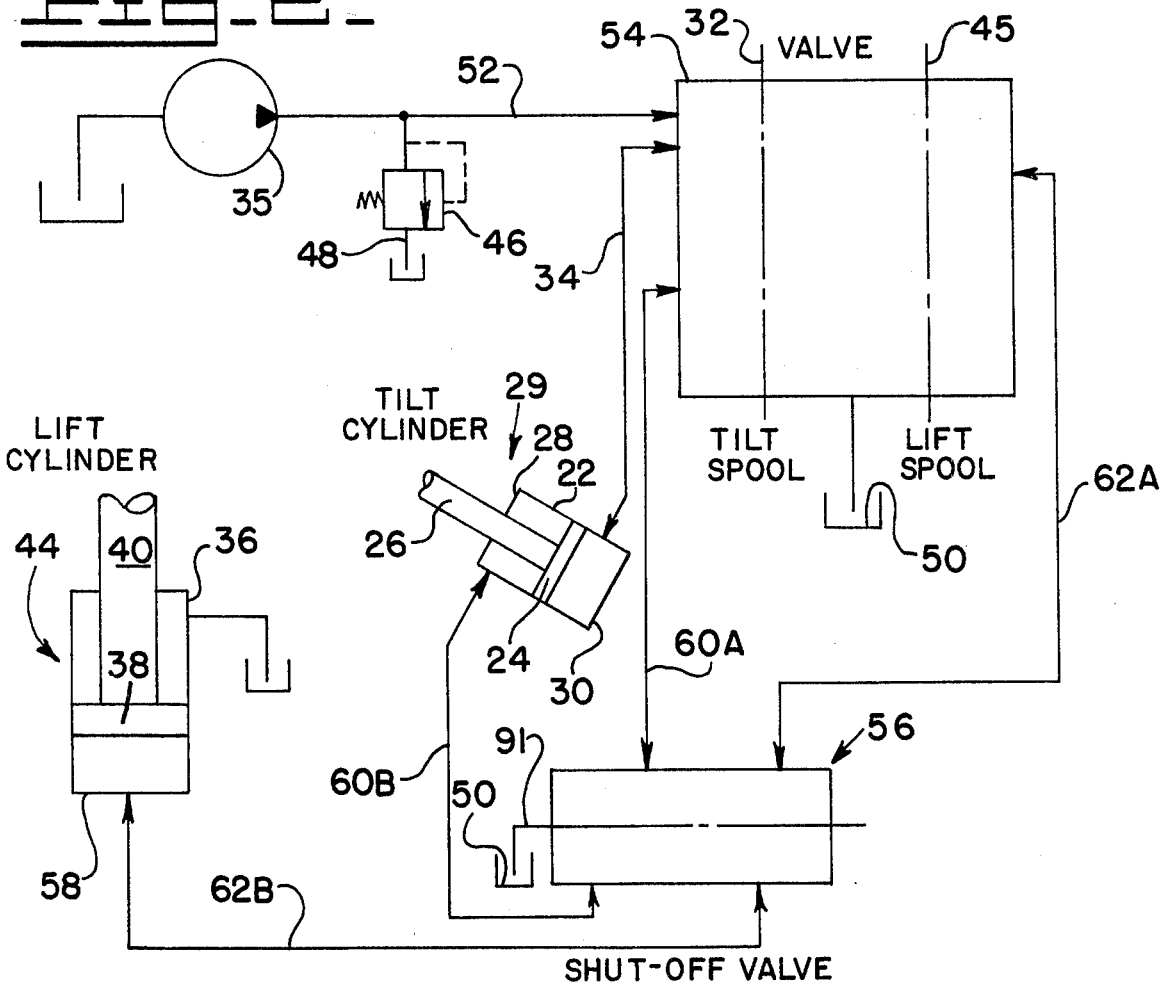
FIG. 2 illustrates diagramatically the improved load sensing device of the present invention and its connection to and in relation with a lift cylinder-piston arrangement and a tilt cylinder-piston arrangement for a lift truck or the like; and, FIG. 3 illustrates in detail the structure of a load sensing valve which protects a lift truck or the like from overbalancing by sensing a moment created by a load thereon.
Figure 3:
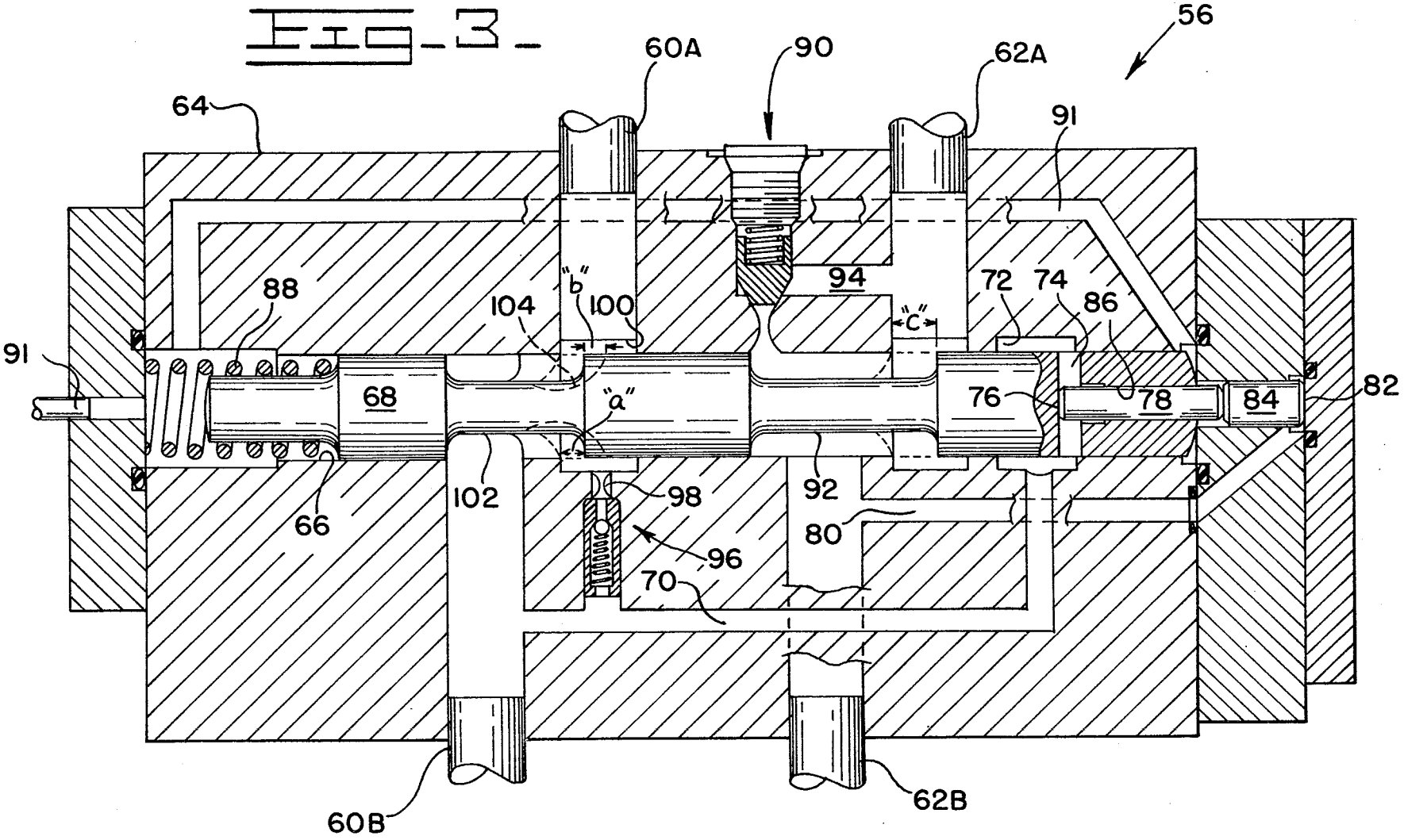

Referring now particularly to FIGS. 2 and 3, there is illustrated a sensing valve 56 which protects the lift truck 10 from overbalancing by sensing a moment created by a load held on the forks 42 thereof. The valve 56 senses simultaneously a lift pressure force proportional to a lift pressure in a head end 58 of the lift cylinder 36 and a tilt pressure force proportional to a tilt pressure in the rod end 28 of the tilt cylinder 22. The valve 56 is capable of blocking flow of pressurized fluid from the tilt cylinder 22 to the tilt valve 32 and is positioned in first conduit means represented by a line 60A communicating between the tilt valve 32 and the sensing valve 56 and a line 60B communicating between the sensing valve 56 and the rod end 28 of the tilt cylinder 22. The valve also is capable of blocking flow of pressurized fluid from the lift valve 45 to the lift cylinder 36. The sensing valve 56 operates responsive to the greater of the lift pressure force and the tilt pressure force exceeding a predetermined value. The sensing valve 56 is positioned in second conduit means represented by a line 62A communicating between the lift valve 45 and the sensing valve 56 and a line 62B communicating the sensing valve 56 and the head end 58 of the lift cylinder 36.

The internal operation of the sensing valve 56 will be most apparent by examination of FIG. 3. In FIG. 3 it is seen that the sensing valve 56 comprises a valve body 64 having a bore 66 passing generally longitudinally therethrough with a spool 68 slidably fitting therewithin. The pressure from the rod end 28 of the tilt cylinder 22 is delivered via the line 60B and a tilt pressure passage 70 to provide a force acting via annulus 72 and cross-bore 74 upon an area equal to the area of an end 76 of a first slug 78 whereby effectively the force acting leftwardly against spool 68 is equal to the area of the end 76 of the slug 78 times the pressure in the rod end 28 of the tilt cylinder 22.

Force from the head end 58 of the lift cylinder 36 is applied via the line 62B and a load pressure passage 80 to an end 82 of a second slug 84. Generally, the end 82 of the second slug 84 has a larger area than does the end 76 of the first slug 78. Thus, the spool 68 is more sensitive to excessive pressure within the head end 58 of the lift cylinder 36. It is further clear that force exerted against the end 82 of the second slug 84 will act against the spool 68 to force it leftwardly. Thus, the greater force due to the pressure in the rod end 28 of the tilt cylinder 22 and in the head end 58 of the lift cylinder 36 is applied in a first direction, namely leftwardly in FIG. 3, against the spool 68. The first slug 78 is slidably fit within a longitudinal bore 86 within the spool 68 so as to allow application of the force exerted against the end 82 of the second slug 84. It is further clear that the spool 68 is normally biased to a predetermined value by biasing means such as the spring 88 rightwardly in an opposite direction from the force exerted due to the pressures in the rod end 28 of the tilt cylinder 22 and the head end 58 of the lift cylinder 36. Flow leakage path 91 leads from between the first slug 78 and the second slug 84 to the sump 50.

FIG. 3 illustrates the sensing valve 56 in the position it would assume when there was no load or at least an insufficient load upon the forks 42 to create sufficient pressure against the end 82 of the second slug 84 or the end 76 of the fist slug 78 to move the spool 68 leftwardly against the force of the spring 88. When the spool 68 is moved leftwardly due to the greater of the aforementioned forces due to the pressures in the rod end 28 of the tilt cylinder 22 and in the head end 58 of the lift cylinder 36 acting against the appropriate areas of the slugs 78 and 84, the spool 68 will cut off flow from the rod end 28 of the tilt cylinder 22 to the tilt valve 32 and will likewise cut off flow from the head end 58 of the lift cylinder 36 to the lift valve 45. More particularly, flow will be cut off between the lines 60A and 60B and between the lines 62A and 62B. First check valve means, in the embodiment illustrated in FIG. 3 a first check valve 90 generally of the spring loaded variety, allows flow from the head end 58 of the lift cylinder 36 about an undercut 92 in the spool 68 and via passage 94 to the line 62A. Thus, the flow in the head end 58 of the lift cylinder 36 can be channeled via the check valve 90 and allowed to pass back via the line 62A to the lift valve 45 and therefrom to the sump 52.

A reduced fluid flow is also allowed by second check valve means, namely a second check valve 96 operating through a constricting orifice 98 whereby when the spool 68 has been moved sufficiently to cut off direct flow from the rod end 28 of the tilt cylinder 22 via line 60B to line 60A and thence to tilt valve 32 and sump 50, pressurized flow can still pass in an opposite direction from line 60A about an annulus 100, through orifice 98 and second check valve 96, along tilt pressure passage 70 and thence to the rod end 28 of the tilt cylinder 22 thereby causing the tilt rod 26 to be retracted due to this increased pressure thus tilting the mast 18 to reduce the moment created by the load upon the forks 42. Thus, when fluid flow away from the rod end 28 of the tilt cylinder 22 is shut off, flow towards said rod end 28 is still possible via the second check valve 96, as just explained.

It will be further noted that the spool 68 includes a second undercut 102 therein and that extending from the second undercut 102 are a pair of passage 104 which lead to a metering of fluid flow out of the rod end 28 of the tilt cylinder 22 and towards the tilt valve 32. Thus, after the slug 68 has moved a first distance "*a*," pressurized fluid can still escape from the rod end 28 of the tilt cylinder 22 to the sump 50 via the tilt valve 32, but it must escape more slowly due to the metering constriction of the passage 104. Then, once the spool 68 has moved a further distance "*b*," flow from the rod end 28 of the tilt cylinder 22 is completely cut off. The use of the metering passages 104 leads to a smooth operation and prevents carryover due to momentum which might lead to premature and unnecessary shutting off of the drain paths from the rod end 28 of the tilt cylinder 22. The distances "*a*" and "*b*" together are generally equal to the distance "*c*" which is the distance which the spool 68 must travel in order to completely shut off the lines 62A from the line 62B other than via the first check valve 90.

OPERATION

In operation, a load will be placed upon the forks 42 as, for example, by the lift truck 10 being driven up to the load and the forks 42 inserted thereunder. Through use of the lift valve 45 and the tilt valve 32, the operator will signal the lift cylinder 32 and the tilt cylinder 22 to operate in a desired manner, for example, to lift the load (via lifting of the forks 42) and/or to tilt the load, as by tilting of the mast 18 about the horizontal pivot 20. If the load is too great for lifting, then the pressure in the head end 58 of the lift cylinder 36 will be great enough to force the spool 68 leftwardly sufficiently to cut off flow from the line 62A to the line 62B and thence to the head end 58 of the lift cylinder 36. Pressure will still be able to escape, however, from the head end 58 of the lift cylinder 36 via the line 62B, the check valve 90, the line 62A and the lift valve 45 to the sump 52. Thus, too heavy of a load will be lowerable but not raisable.

Turning now to the tilt cylinder 29, it is clear that pressurized fluid is normally supplied by the pump 35 via the tilt valve 32 and the line 34 to the head end 30 of the tilt cylinder 22. This leads to movement of the tilt piston 24 leftwardly whereby the load is lowered thus increasing the moment created by it about a vehicle front axle 106. As the moment approaches a value which will cause the vehicle to turn over, the tilt pressure in the rod end 28 of the tilt cylinder 22 will increase significantly. The spool 68 in the sensing valve 56 will be forced leftwardly sufficiently to cut off flow from the line 60B to the line 60A and thence to the tilt valve 32 and the sump 52. Hence, although the tilt valve 32 would be adjusted to supply fluid from the pump 35 via the line 34 to the head end 30 of the tilt cylinder 32, there will be no way for fluid to escape from the rod end 28 thereof. This will lead to the relief valve 46 opening as excess pressure is created in the line 52, allowing a bleed back to the sump 50 via the pressure relief line 48. Meanwhile, pressure in the line 60A can still be applied and is still applied to the line 60B via the restricted orifice 98 and the check valve 96, thus allowing pressure to be increased in the rod end 28 of the cylinder 22 which in turn leads to the tilt piston 24 being forced rightwardly with resulting retraction of the tilt rod 26, and further resulting in lessening of the moment about the front axle 106 of the lift truck 10.

It is, of course, obvious that when a combination operation is being carried out, for example, when a load is being lifted and at the same time being tilted forwardly through extension of the tilt rod 26, then the force tending to move the spool 68 is a resultant force due to the greater of the pressure in the rod end 28 of the tilt cylinder 22 acting against an area equal to that of the end 76 of the first slug 78, and the pressure in the head end 58 of the lift cylinder 36 acting against the end 82 of the second slug 84. It is also clear that the spool 68 cuts off flow from line 60B to line 60A at the same time that it cuts off flow from line 62A to line 62B and that hence the sensing valve 56 is in a very direct manner reacting to the moment created about the front axle 106 of the lift truck 10.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. In a load lifting apparatus which comprises a primary load member pivotally mounted about a generally horizontal axis on a frame, a tilt cylinder and a tilt piston movable relative to one another pivotally connected to the frame and the primary load member to provide impetus for pivotal movement therebetween, a secondary load member movable relative to the primary load member, a lift cylinder and a lift piston movable relative to one another connected to the primary load member and the secondary load member to provide impetus for linear relative movement therebetween, tilt cylinder valve means for controlling flow of pressurized fluid from pump means to said tilt cylinder and lift cylinder valve means for controlling flow of pressurized fluid from said pump means to said lift cylinder, an improvement for protecting said apparatus from overbalancing by sensing a moment created by a load on said apparatus, comprising:

a valve sensing simultaneously a lift pressure force proportional to a lift pressure in a head end of said lift cylinder and a tilt pressure force proportional to a tilt pressure in a rod end of said tilt cylinder, said valve blocking flow of pressurized fluid from the rod end of said tilt cylinder to said tilt cylinder valve means and from said lift cylinder valve means to the head end of said lift cylinder responsive to the greater of said lift pressure force and said tilt pressure force exceeding a predetermined value,

2. An improvement in a load lifting apparatus as in claim 1, wherein said lift pressure force and said tilt pressure force are each exerted in a first direction against a spool of said sensing valve and wherein said lift pressure exerts said lift pressure force by acting against a member exerting a force on said spool, said member having a larger area exposed to said lift pressure than that of said spool exposed to said tilt pressure.

3. An improvement as in claim 2, including first check valve means allowing fluid flow away from said head end of said lift cylinder when fluid flow from said lift cylinder valve means to said head end of said lift cylinder is shut off by said sensing valve.

4. An improvement as in claim 3, including second check valve means allowing a reduced fluid flow to said rod end of said tilt cylinder when a fluid flow away from said rod end of said tilt cylinder is shut off by said sensing valve.

5. An improvement as in claim 4, wherein said sensing valve includes a body with a bore therein, said spool slidingly fitting within said bore and said predetermined value is set by means biasing said spool in a second direction wherein fluid flow to said head end of said lift cylinder and from said rod end of said tilt cylinder is generally unrestricted.

6. An improvement as in claim 5 wherein said sensing valve includes a first slug of a first area slidably fitting longitudinally within a hole in said spool and said member comprises a second slug of a larger area larger than said first area bearing against said first slug and wherein said tilt pressure force acts against a surface area of said spool equal to said first area and said lift pressure force acts against said second area.

7. An improvement as in claim 6, including means in said sensing valve controlling the metering of flow of pressurized fluid from said rod end of said tilt cylinder to said tilt cylinder valve means.

8. In a load lifting apparatus which comprises a primary load member pivotally mounted about a generally horizontal axis on a frame, a tilt cylinder and a tilt piston movable relative to one another pivotally connected to the frame and the primary load member to provide impetus for pivotal movement therebetween, a secondary load member movable relative to the primary load member, a lift cylinder and a lift piston movable relative to one another connected to the primary load member and the secondary load member to provide impetus for linear relative movement therebetween, tilt cylinder valve means for controlling flow of pressurized fluid from pump means to said tilt cylinder and lift cyclinder valve means for controlling flow of pressurized fluid from said pump means to said lift cylinder, an improvement for protecting said apparatus from overbalancing by sensing a moment created by a load on said apparatus, comprising:

a valve sensing simultaneously a lift pressure force proportional to a lift pressure in a head end of said lift cylinder and a tilt pressure force proportional to a tilt pressure in a rod end of said tilt cylinder, said valve blocking flow of pressurized fluid from said tilt cylinder to said tilt cylinder valve means and from said lift cylinder valve means to said lift cylinder responsive to the greater of said lift pressure force and said tilt pressure force exceeding a predetermined value, said lift pressure force and said tilt pressure force being exerted in a first direction against a spool of said sensing valve, said lift pressure exerting said lift pressure force by acting against a member exerting a force on said spool, said member having a larger area exposed to said lift pressure than that of said spool exposed to said tilt pressure, said sensing valve including a body with a bore therein, said spool slidingly fitting within said bore and said predetermined value being set by means biasing said spool in a second direction wherein fluid flow to said head end of said lift cylinder and from said rod end of said tilt cylinder is generally unrestricted, said sensing valve including a first slug of a first area bearing against said spool in said first direction and said member comprising a second slug of a larger area larger than said first area bearing against said first slug and wherein said tilt pressure force acts against a surface are of said spool equal to said first area and said lift pressure force acts against said second area.

9. An improvement as in claim 8, including means in said sensing valve controlling the metering of flow of pressurized fluid from said rod end of said tilt cylinder to said tilt cylinder valve means.

10. An improvement as in claim 8, including first check valve means allowing fluid flow away from said head end of said lift cylinder when fluid flow from said lift cylinder valve means to said head end of said lift cylinder is shut off by said sensing valve.

11. An improvement as in claim 8, including second check valve means allowing a reduced fluid flow to said rod end of said tilt cylinder when a fluid flow away from said rod end of said tilt cylinder is shut off by said sensing valve.

12. An improvement as in claim 1, including means in said sensing valve controlling the metering of flow of pressurized fluid from said rod end of said tilt cylinder to said tilt cylinder valve means.

* * * * *